United States Patent [19]

Lee

[11] 4,223,409

[45] Sep. 23, 1980

[54] HELMET PROVIDED WITH SHOCKPROOF AND VENTILATIVE DEVICE

[76] Inventor: Pei-Hwang Lee, 107, Ming-Chuan Rd., Chia Yi, Taiwan

[21] Appl. No.: 34,599

[22] Filed: Apr. 30, 1979

[51] Int. Cl.[2] ..... A42B 3/02

[52] U.S. Cl. ..... 2/411; 2/414; 2/5

[58] Field of Search ..... 2/411, 412, 414, 422, 2/425, 6, 10, 5, 2, 185 R, 199

[56] References Cited

U.S. PATENT DOCUMENTS

| | | | |
|---|---|---|---|
| 622,677 | 4/1899 | Gallagher et al. | 2/5 X |
| 1,652,776 | 12/1927 | Galanis | 2/414 |
| 3,945,042 | 3/1976 | Lobo | 2/2 |
| 4,020,507 | 5/1977 | Morton | 2/411 |

FOREIGN PATENT DOCUMENTS

| | | | |
|---|---|---|---|
| 43373 | 8/1910 | Austria | 2/411 |
| 458497 | 10/1926 | Fed. Rep. of Germany | 2/411 |
| 619712 | 9/1935 | Fed. Rep. of Germany | 2/422 |

*Primary Examiner*—Peter P. Nerbun

[57] ABSTRACT

This invention relates to a helmet provided with shockproof and ventilative devices, the helmet being encircled with a plurality of plastic strips along its outer wall, and a plurality of corresponding plastic or rubber tubes along its inner wall, the upper portion of the helmet being filled with sponge material, thereby to give a wearer protection against shock.

6 Claims, 3 Drawing Figures

HELMET PROVIDED WITH SHOCKPROOF AND VENTILATIVE DEVICE

BACKGROUND OF THE PRESENT INVENTION

1. Field of the Present Invention

This invention relates to a helmet provided with shockproof and ventilative devices to be worn by firemen, policemen or soldiers, particularly to be worn by motorcycle drivers and passengers.

2. Description of the Prior Art

A helmet is a necessary protective covering for the head of firemen, policemen, drivers or soldiers, which gives a wearer protection against the sun, wind, rain and shock. Up to now, there are many known kinds of helmets developed in this art.

The conventional helmets either made of steel, plastic or other materials are not satisfactory enough, most of them being too heavy which is liable to fatigue the wearer.

Generally speaking, the known helmets all have a disadvantage in common, that is, poor ventilation. During the summer, it is not easy for a motorcycle driver to concentrate his attention on dull driving especially when he wears a heavy and unventilative helmet.

Furthermore, the known safety cap gives the wearer no absolute protection against unexpected shock; in other words, a motorcycle driver can not avoid being hurt in the head in a traffic accident even though he wears a safety cap.

SUMMARY OF THE PRESENT INVENTION

Accordingly, an important object of the present invention is to provide an improved helmet provided with shockproof devices to be worn by motorcycle drivers and passengers particularly. The helmet is encircled with a plurality of plastic strips along its outer wall and a plurality of plastic or rubber tubes along its inner wall, which may be useful in protecting the wearer from injury, or even death.

Another object of the present invention is to provide an improved helmet provided with a ventilative device which achieves good ventilation at all times. In addition to this, the wearer may still hear clearly.

A further object of the present invention is to provide an improved helmet, wherein the upper portion thereof is filled with sponge material so as to give the wearer comfort and safety.

BRIEF DESCRIPTION OF THE DRAWINGS

These and other objects and advantages of the invention will be more clearly understood by reference to the accompanying drawings forming a part of the instant specification, in which.

DETAILED DESCRIPTION OF THE PREFERRED EMBODIMENT

Figure 1:
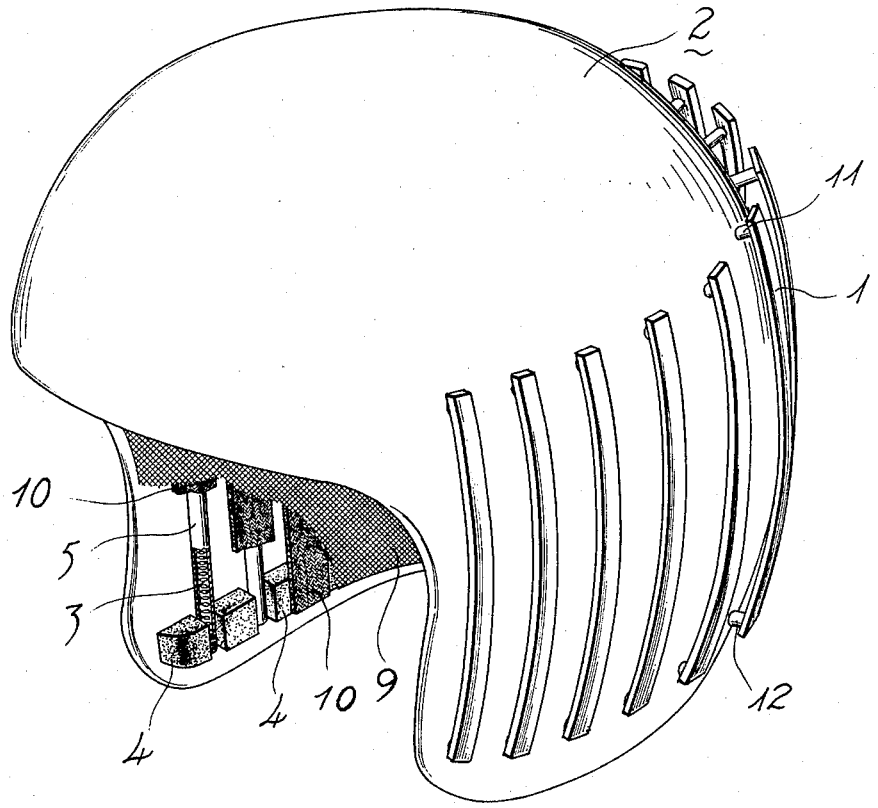
FIG. 1 is a view showing the improved helmet of this invention, with part of the inner gauze layer removed.
Figure 2:
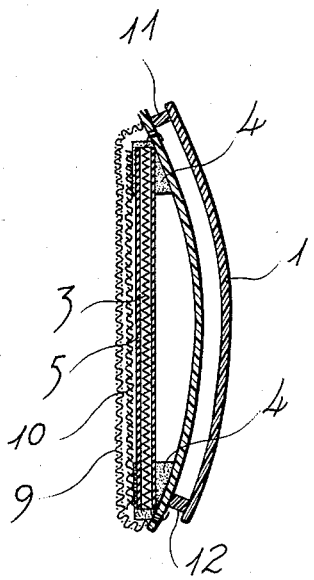
FIG. 2 is a longitudinal sectional view showing a plastic strip and its corresponding tube shown in FIG. 1.

Referring to FIGS. 1 & 2, a helmet 2 made of plastic is encircled with a plurality of spaced plastic strips 1 along its outer wall, the plastic strips 1 being secured adjacent their ends to the helmet 2 by plastic cylindrical spacer pads 11, 12. The plastic strips 1 and plastic pads 11, 12 as a whole serve as a first buffer to prevent the wear's head from shock; the hard shell of the helmet 2 will serve as a second buffer to protect the head from being hurt.

A plurality of spaced plastic or rubber tubes 5 corresponding in number to said plastic strips 1 are arranged along the inner wall of the helmet 2. Provided inside each tube 5 is a spring 3, secured at each end thereof to the helmet wall through small apertures adjacent the ends of tubes 5 (see FIG. 2) each upper and lower clearance space between two tubes 5 being secured with a piece of sponge material 4. Gauze 9 is adopted as the innermost layer for the helmet, and a flexible band 10 is interposed between the gauze 9 and each said tube 5; the tubes 5, springs 3, sponge 4 and flexible bands 10 thereof may altogether serve as a third buffer to bear an unexpected shock or blow. Therefore, the motorcycle driver or passengers may avoid being hurt in the head.

Figure 3:
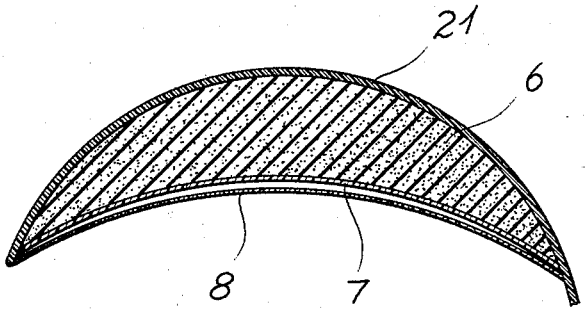
FIG. 3 is a sectional view showing the upper portion of the helmet shown in FIG. 1.

Referring to FIG. 3, wherein upper portion 21 of the helmet 2 shown in FIG. 1 is filled with sponge member 6, lower convex surface of the sponge member is laminated with a sheet of plastic 7 and a spaced layer of netting-cloth 8 in turn. The thick layer of sponge 6, plastic sheet 7 and netting-cloth 8 may act as a fourth buffer of the helmet, being effective in giving further protection for the head.

Fresh air may circulate freely through the gauze layer 9 in the clearance space between the tubes 5 and inner wall of the helmet. Thus, good ventilation of the whole helmet 2 is achieved at all times; in addition, the wearer may still hear clearly although there is no hole formed (or needed) to allow the good air to come in and bad air to go out.

Accordingly, it is expressly intended that the foregoing description is illustrative of a preferred embodiment only, not limiting, and that the true spirit and scope of the present invention is to be determined by reference to the appended claims.

What is claimed is:

1. A protective helmet for protecting the head of a user against shock, and having improved ventilating qualities, said helmet comprising:

a helmet body;

a plurality of spaced elongated plastic strips positioned along the outer surface of said helmet body, said strips being spaced from each other and from said outer surface;

a pair of strip-mounting pads associated with each said strip for securing the two ends of each said strip to said outer surface in spaced relation thereto;

a sponge-like member filling the upper portion of said inner surface, said sponge member having a plastic sheet covering its lower surface and a spaced layer of netting-cloth covering said plastic sheet; and a plurality of spaced elongated plastic or rubber tubes mounted along the lower portion of said inner surface of said helmet body, said tubes being spaced from each other, at least the central portion of each said tube being spaced from said inner surface.

2. The protective helmet as claimed in claim 1, including an elongated spring disposed within each said tube and secured at each end thereof to said helmet body.

3. The protective helmet as claimed in claim 1, including a pad of sponge-like material between each pair of tubes at each end of each tube pair.

4. The protective helmet as claimed in claim 1, including a gauze inner layer covering said plurality of tubes.

5. The protective helmet as claimed in claim 4, including a plurality of elongated flexible bands, each band extending the length of a corresponding tube, and each band positioned between said corresponding tube and said gauze inner layer.

6. The protective helmet as claimed in claim 1, wherein there is a corresponding number of said strips and tubes, and each said strip is mounted opposite each said tube.

* * * * *